US007182245B1

(12) United States Patent
Nieto

(10) Patent No.: US 7,182,245 B1
(45) Date of Patent: Feb. 27, 2007

(54) THEFT RESISTANT MAILBOX

(76) Inventor: Arthur Nieto, 1032 Riverview Pl., NW., Albuquerque, NM (US) 87105

( * ) Notice: Subject to any disclaimer, the term of this patent is extended or adjusted under 35 U.S.C. 154(b) by 8 days.

(21) Appl. No.: 11/147,793

(22) Filed: Jun. 7, 2005

Related U.S. Application Data

(60) Provisional application No. 60/577,763, filed on Jun. 7, 2004.

(51) Int. Cl.
*B65G 11/04* (2006.01)

(52) U.S. Cl. ..... 232/45; 232/17; 232/29

(58) Field of Classification Search ..... 232/45, 232/17, 47, 43.4, 29, 33, 21, 24, 43.3; D99/29
See application file for complete search history.

(56) References Cited

U.S. PATENT DOCUMENTS

| | | | | | |
|---|---|---|---|---|---|
| 1,480,452 | A * | 1/1924 | Kolstad | 232/17 |
| 4,753,386 | A * | 6/1988 | Phillion, Sr. | 232/43.1 |
| 4,905,891 | A * | 3/1990 | Wildish et al. | 232/17 |
| 5,071,063 | A * | 12/1991 | Overstreet | 232/17 |
| 5,096,115 | A * | 3/1992 | Hassan | 232/17 |
| 5,143,284 | A * | 9/1992 | Socarras | 232/21 |
| 5,148,974 | A * | 9/1992 | Clapper | 232/17 |
| 5,207,377 | A * | 5/1993 | Brecht | 232/17 |
| 5,351,883 | A * | 10/1994 | Pachl | 232/17 |
| 5,526,979 | A * | 6/1996 | Mann | 232/33 |
| 5,938,113 | A * | 8/1999 | Kim | 232/47 |
| 6,234,388 | B1 * | 5/2001 | Taylor | 232/47 |
| 6,247,642 | B1 * | 6/2001 | Wilson, Jr. | 232/47 |
| 6,722,561 | B1 * | 4/2004 | Thomas et al. | 232/39 |
| 6,736,310 | B1 * | 5/2004 | Mesol | 232/39 |
| 6,799,716 | B1 * | 10/2004 | Kuelbs | 232/39 |
| 6,974,074 | B1 * | 12/2005 | Watts | 232/45 |
| 7,048,177 | B1 * | 5/2006 | Franklin | 232/17 |
| 2004/0074957 | A1 * | 4/2004 | Devar | 232/17 |
| 2004/0238615 | A1 * | 12/2004 | Offenbacher | 232/29 |
| 2005/0006451 | A1 * | 1/2005 | Taylor | 232/45 |

* cited by examiner

*Primary Examiner*—William L. Miller
(74) *Attorney, Agent, or Firm*—Vidal A. Oaxaca; Jeffrey D. Myers; Peacock Myers, P.C.

(57) ABSTRACT

A mailbox which has a plate along which mail slides before it falls into a rear compartment, which is not easily accessible from the front of the mailbox. A rear door can optionally be locked in its closed position, and only by successfully opening this door can a person obtain mail deposited within the mailbox of the present invention. All of this is achieved while maintaining a relatively small mailbox size.

16 Claims, 4 Drawing Sheets

THEFT RESISTANT MAILBOX

CROSS-REFERENCE TO RELATED APPLICATION

This application claims priority to and the benefit of the filing of U.S. Provisional Patent Application Ser. No. 60/577,763, entitled "Theft Protection Mailbox", filed on Jun. 7, 2004, and the specification thereof is incorporated herein by reference.

BACKGROUND OF THE INVENTION

1. Field of the Invention (Technical Field):

The present invention relates to a mailbox. Particularly, the present invention relates to a mailbox which is not excessively large and bulky, and which is resistant to theft of items disposed therein due to its internal design.

2. Background Art

The theft of mail is a continuing problem with conventional mailboxes, such as the common "rural" style box typically employed in rural and suburban neighborhoods. A conventional mailbox simply has a hinged door, and can be opened and accessed by anyone. Theft of mail is common, including theft of items such as checks, social security checks, credit cards and the like, and is a contributing factor to identity theft.

There are a number of patents which disclose various mailboxes with security features. However, all of the heretofore known mailboxes have limitations. For example, U.S. Pat. No. 6,247,642 discloses a mailbox that is approximately three times the height of a conventional box. With such an unusually large height, not only is this mailbox bulky and distracting to observers from the surrounding landscape, but such a large mailbox also requires more material to produce and is thus more expensive to manufacture and ship. U.S. Pat. Nos. 5,938,113; 5,526,979; and 4,993,626 are similar to the foregoing patent, and these mailboxes also suffer the same drawbacks of the mailbox described in that patent. Other patents, such as U.S. Pat. No. 3,880,344, involve complex shapes and are large and unwieldy in design. Still other patents, such as U.S. Pat. Nos. 3,758,027 and 3,401,875, incorporate complex mechanical components, and optionally require the use of heavy gage metal construction or specialized shapes. There is thus a need for a mailbox which can provide protection from theft of items disposed therein while not being overly large and while not requiring complex or unwieldy shapes.

BRIEF SUMMARY OF THE INVENTION

Briefly stated, the present invention includes a mailbox that is elongated, and includes within it a shelf which is preferably sloping, such that due to the slope of the shelf or a shove from a user, the mail can physically travel beyond the edge of the shelf and fall therebelow. The mailbox preferably has an ordinary hinged door on the front, which need not be lockable, and a hinged door on the rear, which preferably is lockable. First class mail can be placed within the box and the shelf and slid toward the rear thereof until such mail falls off the shelf. Upon falling from the shelf, the mail preferably falls to the bottom of the mail box, and is positioned such that the arm of a person cannot retrieve the mail so deposited when the person is attempting to snatch the mail through the front door of the mailbox. Thus the mail is secured, and can be retrieved only by a person who can access the rear door. As such, the mail can preferably only be retrieved by a person who has a key that enables such a person to access the rear door. Small parcels and other than first class mail may be placed beneath the shelf, and is thus accessible only from the front, by opening the front door. In another embodiment, the mailbox preferably includes a rear chamber into which mail is slid from the shelf, which rear chamber preferably extends, on the bottom plane, an additional distance, thereby defining a different height for the chamber at the rear of the box as compared to the chamber at the front of the box.

The invention thus provides a theft resistant mailbox which includes a substantially elongated structure wherein movably positional doors are disposed at proximal and distal ends of said structure; a plate disposed within and a distance above a bottom of said structure, wherein said plate spans at least a substantial distance across an internal width of said elongated structure; a front chamber; a rear chamber; and a locking mechanism. In one embodiment the plate is disposed in a substantially parallel fashion with the bottom of said structure. In another embodiment the plate is disposed such that a distance between its proximal end and a top of said structure is substantially less than a distance between a terminal end of said plate and a top of said structure. In yet another embodiment, a proximal end of said plate is disposed a distance of at least one-half the height of a proximal opening of said elongated structure. In yet another embodiment a proximal end of said plate is disposed less than two inches below a top of said elongated structure, such as less than about one and one-fourth inches below a top of said elongated structure. In the theft resistant mailbox the rear chamber preferably extends below said front chamber. The locking mechanism is provided such that it locks said door disposed at said distal end of said structure in a closed position. The theft resistant mailbox can further include a movably positional flag. In one embodiment of the theft resistant mailbox, a maximum height of said elongated structure is less than about 14 inches.

It is preferred that the plate extends substantially the same distance within said elongated structure as said front chamber. The plate can further provide a second portion, which may be of the same material, which forms a barrier between the front chamber and the rear chamber, which barrier is connected to or proximate to the bottom of the structure. Thus in this way the front chamber is isolated from the rear chamber other than by means of the space above the plate.

The invention further provides a method for securing mail in a mail box, the method including the steps of: providing a substantially elongated structure having at least one front door and at least one rear door, wherein the rear door is lockable in a closed position; disposing a plate within said structure and positioned a distance above a bottom of the structure; providing front and rear chambers, wherein said rear chamber is accessible via the rear door; and wherein at least one piece of mail is slideable across the plate and disposable within the rear chamber. In this method, the step of providing front and rear chambers can include providing a rear chamber which extends a distance below the front chamber. The plate may be in a substantially parallel fashion with a top of the elongated structure, or may be in a non-parallel fashion with a top of the elongated structure. The step of disposing a plate can include positioning the plate in such a non-parallel fashion that when an envelope is placed thereon, the envelope will slide down the plate. Thus the step of disposing a plate can include placing a proximal edge of the plate less than about two inches from a top of the structure, or alternatively placing a proximal edge of the plate less than about one and one-quarter inches from a top of the elongated structure. In the method the front chamber can include a rear wall which prevents mail from being passed from the rear chamber to the front chamber. The method can further include the step of providing a movably positional flag.

A primary object of the present invention is to provide a secured mailbox which does not require or use complex mechanical components, and which is as close in size to a conventional mailbox as is possible.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention is directed to theft-resistant mailboxes, particularly to theft-resistant mailboxes which are relatively close in dimension to a standard size mailbox.

The term "plate" as used throughout the specification and claims of this application is used for the sake of simplicity and to maintain consistency throughout this application. The term "plate" is not limited only to smooth plainer objects, but rather can include any type of structure so long as it is capable of supporting the weight of an envelope resting on it, or sliding down it. Upon studying this application, those skilled in the art will readily recognize that the "plate" can be made of virtually any material and can be textured or substantially flat and yet still produce desirable results. Further, the "plate" is not limited to being only a solid surface, rather it can be a grill-type structure wherein a plurality of rods or other elongated members are disposed near one another and reside in a substantially parallel fashion therewith. The "plate" may further include rollers or other friction-reducing elements to facilitate the movement of mail therealong.

Figure 1:
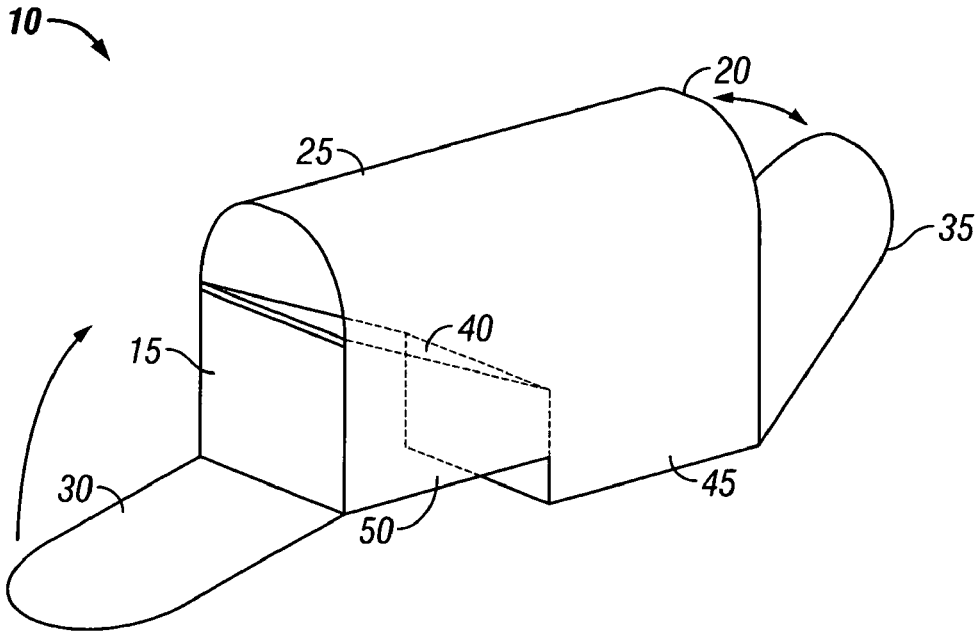
FIG. 1 is a drawing depicting a perspective view of a mailbox of the present invention in which internal features of the mailbox are visible.

FIG. 1 is a perspective view drawing depicting an embodiment of the present invention wherein a side panel is depicted as being transparent such that internal features of mailbox 10 can be better depicted and thus more easily understood by those reading this application. Although a side of mailbox 10 is being depicted as being transparent, this is only done for clarity and to aid in a better understanding of an embodiment of the present invention. Mailboxes constructed in accordance with the present invention can be made from virtually any material capable of withstanding exposure to the whether, as well as materials which are not capable of withstanding exposure to the whether so long as such materials are properly treated, coated, or otherwise sheltered from the elements. The mailbox of the present invention is preferably made from a metal, plastic, or a combination thereof and most preferably is made from tin which itself is preferably galvanized or painted. In one embodiment mailbox 10 is of a generally conventional design. Mailbox 10 preferably has front opening 15 and rear opening 20 disposed respectively at proximal and distal ends of housing 25. Front door 30 is preferably pivotally connected to a bottom portion of mailbox 10 through any one of the well known methods of pivotal attachment known to those of skill in the art. Rear door 35 is also preferably hingedly attached to a bottom portion of mailbox 10 through any of the well known methods of pivotal attachment.

Internally disposed within housing 25 preferably resides plate 40. In one embodiment of the present invention, plate 40 resides in a substantially parallel alignment with a bottom of mailbox 10. As such, when mailbox 10 is properly mounted or otherwise installed, plate 40 is substantially horizontal and mail which is disposed thereon preferably will not slide due to gravity. In the most preferred embodiment, however, plate 40 is disposed within housing 25 at an angle (see FIG. 1). In this embodiment, when mailbox 10 is properly mounted or otherwise installed, mail placed on plate 40 preferably slides down plate 40 due to the force of gravity exerted thereon. In this embodiment, when mail has slid past a proximal end of plate 40 it falls into rear chamber 45. If plate 40 is installed in a substantially horizontal manner, such that mail deposited on it does not slide, it is preferable that the person leaving the mail physically shove it along plate 40, with the fingertips of the user, until the mail falls into rear chamber 45.

The proximal end of plate 40 is preferably disposed more than halfway up opening 15, and more preferably about two inches or less from a top of opening 15, and most preferably about one and one-fourth inches or less from a top of opening 15. If mailbox 10 is constructed having a typical domed top with vertical sides, as is most common in mailbox construction, the proximal end of plate 40 is then disposed at the height where the vertical sides terminate and the curve of the top begins (see FIGS. 1, 2, and 3). It is further preferable that the distal end of plate 40 be positioned at some height above a bottom of front opening 15, thus forming front chamber 50 which has an open proximal end and a closed distal end. As such, access to rear chamber 45 cannot be obtained via front chamber 50. While not critical, it is preferable that the closed distal end of front chamber 50 preferably be disposed a distance above its floor. The height that this affords front chamber 50 at its distal end enables that chamber to be used for placement of larger-sized mail items, which due to the limited clearance above plate 40, prevents such items from being slid thereon. Other non-security sensitive items such as magazines, and "junk mail" can be left in front chamber 50. And such items so left can easily be retrieved by the recipient of such mail simply by the recipient opening front door 30 of mailbox 10.

Figure 2:
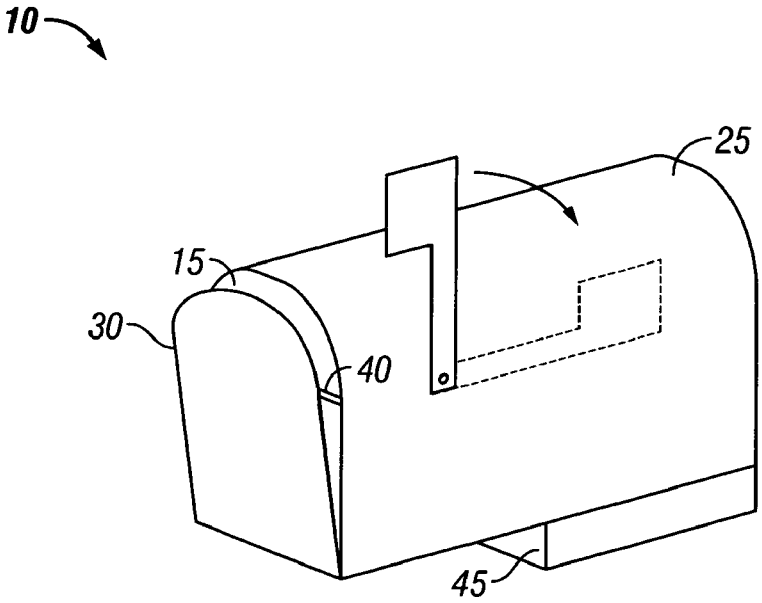
FIG. 2 is a drawing depicting a perspective view of the mailbox of the present invention.
Figure 3A:
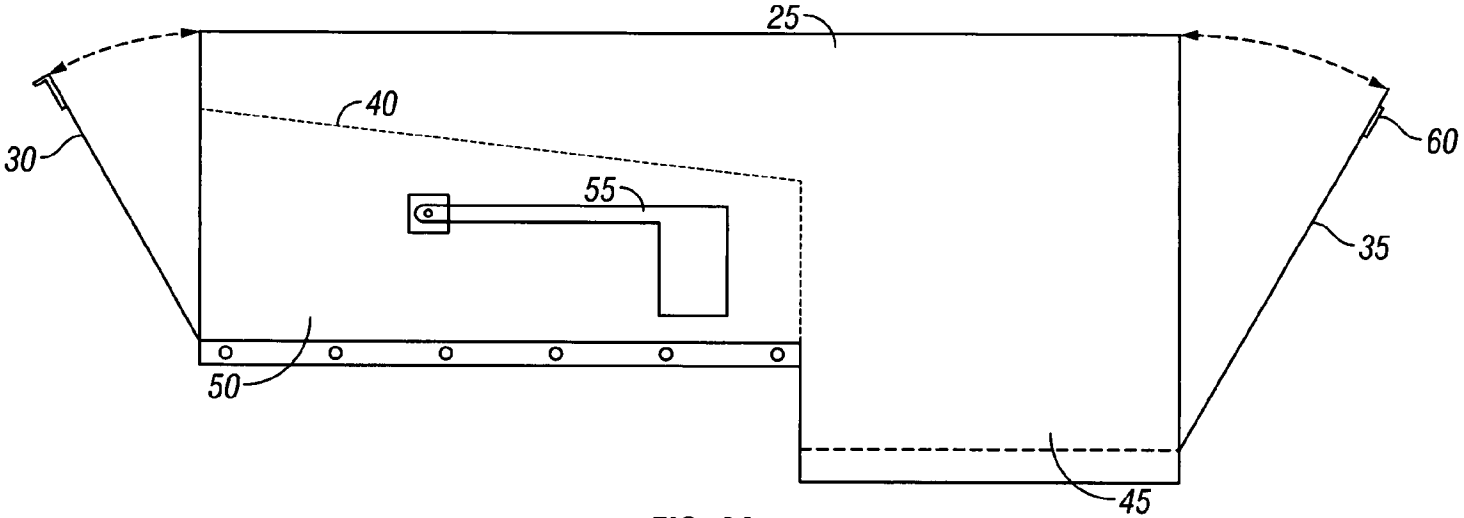
FIGS. 3A, 3B, and 3C are side, front, and back views respectively which depict an embodiment of the present invention.
Figure 3C:
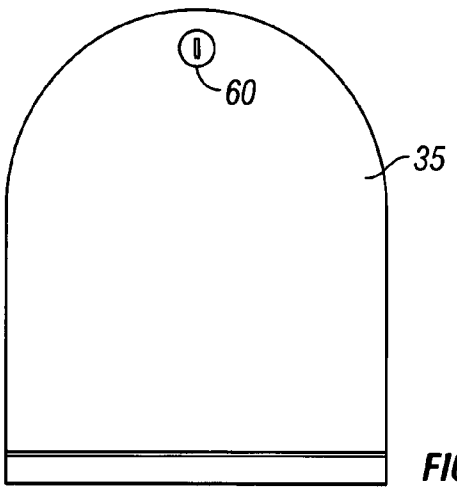
Figure 3B:
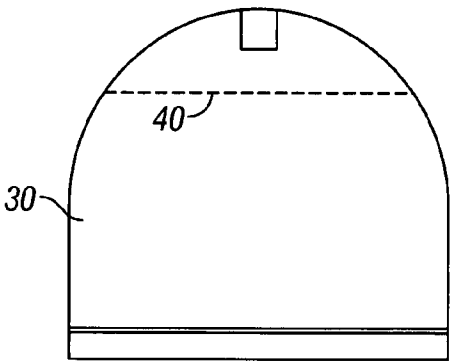

If plate 40 is disposed in a sloped manner, mail left for the mailman must be placed in front chamber 50 since items placed on plate 40 would slide down it and fall into rear chamber 45. As best depicted in FIG. 2, when outgoing mail is placed in chamber 50, flag 55 is preferably pivotally raised to indicate the existence of such mail.

Preferably plate 40 further includes a back portion, such that rear chamber 45 is isolated from chamber 50 except for the sloped area above plate 40. Thus rear chamber 45 is separated from chamber 50.

Chamber 50 may thus be utilized for outgoing mail, and may further be utilized by the mailman for delivery of small parcels, other than first class mail, and the like.

After incoming mail has either been shoved down plate 40 or slid down plate 40, and has fallen into rear chamber 45, a person can preferably no longer reach such mail through front opening 15 of mailbox 10. This is because the only opening to rear chamber 45 from front opening 15 is above plate 40, and because plate 40 is preferably disposed near a top of mailbox 10 at a distance therefrom as previously described. The height of the opening above plate 40 is thus too small for a person to shove a hand or arm therethrough. As such, the height of the opening above the proximal end of plate 40 is preferably just enough to enable a person to shove mail back along plate 40 using his or her fingertips. Thus, mail residing in rear chamber 45 must be retrieved by opening rear door 35. Since one of the objectives of the present invention is to provide a mailbox which prevents theft of mail, lock 60 is preferably used to fixedly secure rear door 35 in its closed position until such time as lock 60 is deactivated. Upon studying this application, those skilled in the art will readily recognize that lock 60 can be of virtually any type, design, and/or construction, and can be disposed virtually anywhere on mailbox 10 so long as it is made to lock door 35 in its closed position. It is most preferable that lock 60 be a keyed lock which is most preferably disposed on rear door 35 itself. As such, a user wishing to retrieve mail from rear chamber 45 must preferably possess the correct key. Of course an additional locking mechanism can be used for added security. For example, a conventional padlock can be used in conjunction with a hasp which can be used to secure rear door 35 to housing 25 in a closed fashion.

Figure 4A:
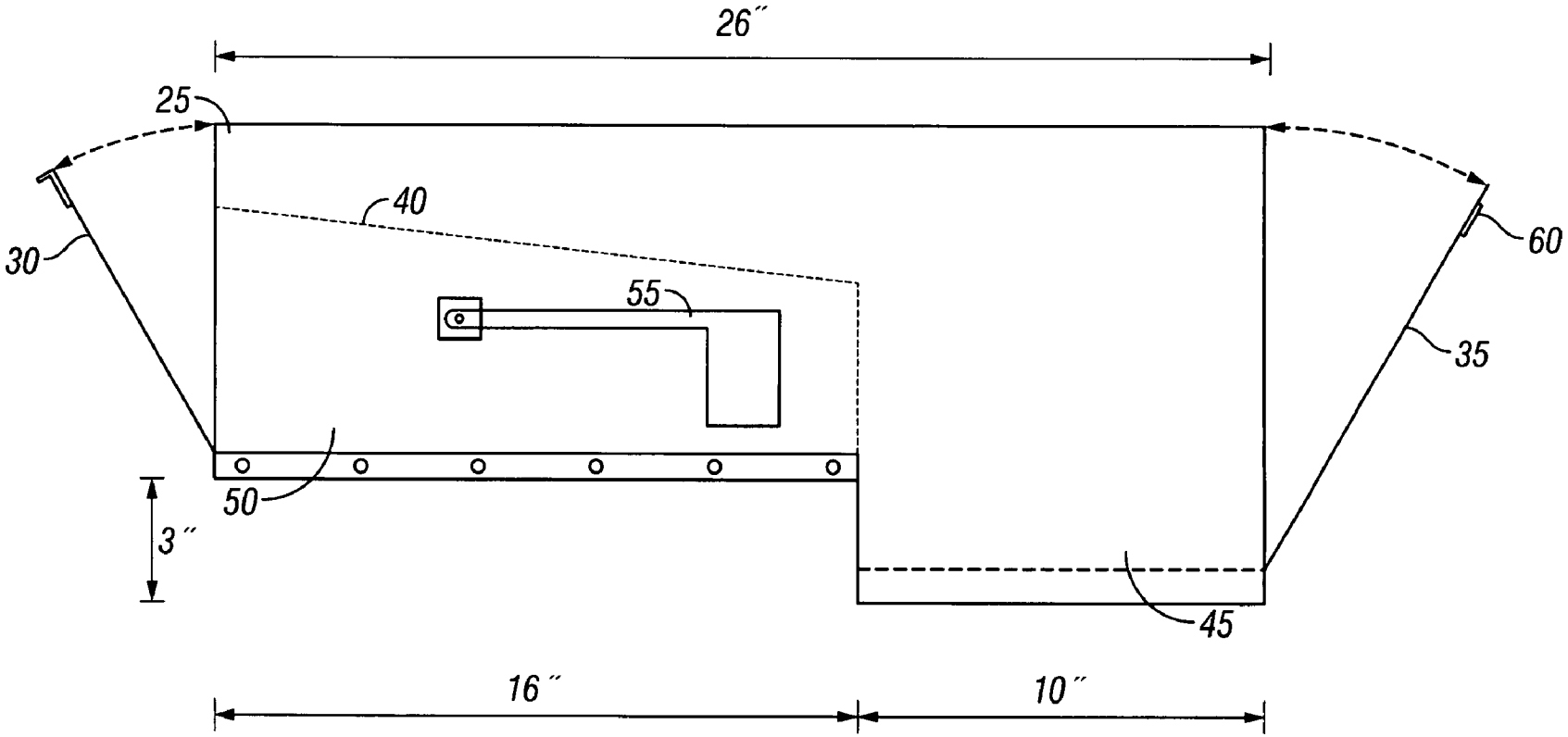
FIGS. 4A, 4B, and 4C are side, front, and back views respectively which depict an embodiment of the present invention along with the most preferable dimensions thereof.
Figure 4C:
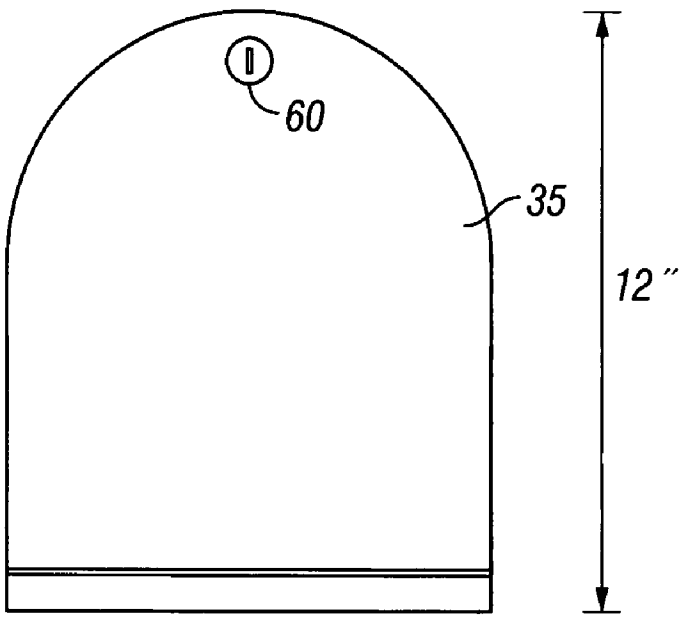
Figure 4B:
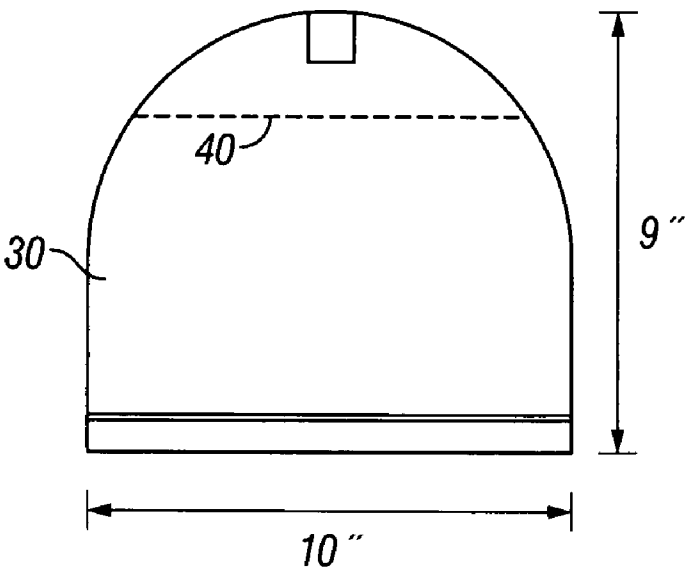

While mailbox 10 can be made to numerous dimensions, the dimensions most preferably used for mailbox 10 are depicted in FIGS. 4A, 4B, and 4C. As depicted therein, the height of the front of mailbox 10 is most preferably about 9 inches. The overall length and overall width of mailbox 10 is most preferably about 26 inches and about 10 inches respectively. The height of the rear of mailbox 10 is most preferably about 12 inches. With the aforementioned dimensions, it is easy to see that the bottom of rear chamber 45 most preferably drops about another three inches below the bottom of front chamber 50. This additional drop of about three inches makes it even more difficult for a person to insert an object along plate 40, make a right angled turn and proceed straight down to the bottom of rear chamber 45 and thus remove items therefrom without a key to unlock lock 60. As such, this preferred additional depth to rear chamber 45 preferably increases the security of mailbox 10. The rear portion of plate 40, which is parallel to the doors when the doors are in a closed position, may be coextensive with the portion forming an additional depth to rear chamber 45, or alternatively it may be placed elsewhere, for example such that it is closer to the front portion of the mailbox 10.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above and/or in the attachments, and of the corresponding application(s), are hereby incorporated by reference.

What is claimed is:

1. A theft resistant mailbox comprising:

a substantially elongated structure having a length of said structure greater than a height of said structure;

movably positional doors disposed at proximal and distal ends of said structure;

a plate disposed within said structure, said plate having a sloped portion and a rear portion, said sloped portion having a proximal end and a terminal end, said rear portion extending from said terminal end, wherein said plate spans at least a substantial distance across an internal width of said elongated structure and wherein said plate is disposed such that a distance between said proximal end of said sloped portion and said top of said structure is less than a distance between said terminal end of said sloped portion and said top of said structure so that said sloped portion has a slope from its proximal end to its terminal end, said rear portion of said plate being substantially parallel to said doors when said doors are in a closed position;

said plate dividing the interior of said structure into a front chamber and a rear chamber;

and a locking mechanism for one of said doors.

2. The theft resistant mailbox of claim 1 wherein said proximal end of said sloped portion is disposed a distance of at least one-half the height of a proximal opening of said elongated structure.

3. The theft resistant mailbox of claim 1 wherein said proximal end of said sloped portion is disposed less than two inches below said top of said elongated structure.

4. The theft resistant mailbox of claim 1 wherein said proximal end of said sloped portion is disposed less than about one and one-fourth inches below said top of said elongated structure.

5. The theft resistant mailbox of claim 1 wherein said rear chamber extends below said front chamber.

6. The theft resistant mailbox of claim 1 wherein said locking mechanism locks said door disposed at said distal end of said structure in said closed position.

7. The theft resistant mailbox of claim 1 further comprising a movably positional flag.

8. The theft resistant mailbox of claim 1, where a maximum height of said elongated structure is less than about 14 inches.

9. The theft resistant mailbox of claim 1 wherein said plate extends substantially the same distance within said elongated structure as said front chamber.

10. A method for securing mail comprising the steps of:

providing a substantially elongated structure having a length of said structure greater than a height of said structure and having at least one front door and at least one rear door, wherein the rear door is lockable in a closed position;

disposing a plate within said structure said plate having a sloped portion and a rear portion, said sloped portion having a proximal end and a terminal end, said rear portion extending from said terminal end, distance between said proximal end of said sloped portion and a top of said structure being less than a distance between said terminal end of said sloped portion and said top of said structure so that said sloped portion has a slope from its proximal end to its terminal end said rear portion of said plate being substantially parallel to said front and said rear doors when said front and rear doors are in a closed position;

providing front and rear chambers via said plate dividing the interior of said structure into said chambers, wherein said rear chamber is accessible via the rear door; and wherein at least one piece of mail is slideable across the plate and disposable within the rear chamber.

11. The method of claim 10 wherein the step of providing front and rear chambers comprises providing the rear chamber so that the rear chamber is a distance below the front chamber.

12. The method of claim 10 wherein the step of disposing a plate comprises positioning the sloped portion in such a non-parallel fashion that when an envelope is placed thereon, the envelope will slide down the sloped portion.

13. The method of claim 10 wherein the step of disposing a plate comprises placing said proximal end of the sloped portion less than about two inches from said top of the structure.

14. The method of claim 10 wherein the step of disposing a plate comprises placing said proximal end of the sloped portion less than about one and one-quarter inches from said top of the elongated structure.

15. The method of claim 10 wherein the rear portion of said plate prevents mail from being passed from the rear chamber to the front chamber.

16. The method of claim 10 further comprising the step of providing a movably positional flag.

* * * * *